United States Patent [19]

Callanan et al.

[11] 4,318,426

[45] Mar. 9, 1982

[54] PIPE THREAD PROTECTOR

[76] Inventors: Robert F. Callanan, 2359 Chestnut Ave., Long Beach, Calif. 90806; Michael D. Soutsos, 5475 Colorado St., Long Beach, Calif. 90814

[21] Appl. No.: 153,588

[22] Filed: May 27, 1980

Related U.S. Application Data

[63] Continuation-in-part of Ser. No. 127,941, Mar. 7, 1980, abandoned.

[51] Int. Cl.[3] ..... B65D 59/00

[52] U.S. Cl. ..... 138/96 T

[58] Field of Search ..... 138/96 T, 96 R

[56] References Cited

U.S. PATENT DOCUMENTS 2,251,428 8/1941 Smith ..... 138/96 R

FOREIGN PATENT DOCUMENTS 672432 10/1963 Canada ..... 138/96 T

*Primary Examiner*—Willis Little

*Attorney, Agent, or Firm*—Michael Bak-Boychuk

[57] ABSTRACT

A resilient pipe thread protector comprises a substantially annular resilient body having an interior opening provided with a thread pattern conformed to mate with the threads of the ends of a drill pipe. To allow for installation onto drill pipes of various sizes the thread protector includes a convolved split defining a plurality of interlocking projections and includes a similarly patterned circular spring within the interior thereof. The foregoing assembly may be formed by injection molding with the convolved split being achieved through the use of a separator plate splitting the mold.

In the alternative the convolved split may be formed along inclined surfaces where each projection is received in a pocket-like recess conformed for telescopic receipt thereof.

6 Claims, 11 Drawing Figures

FIG. 1
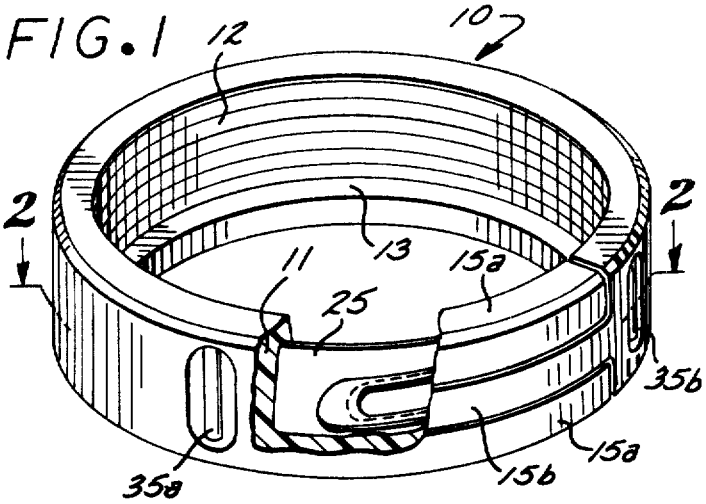
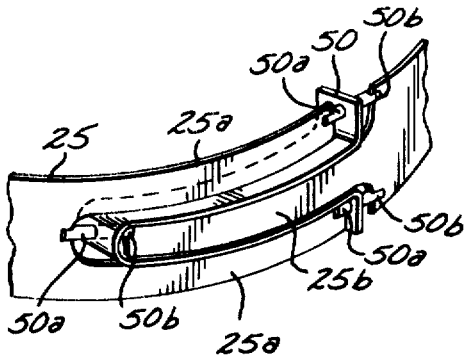
FIG. 3
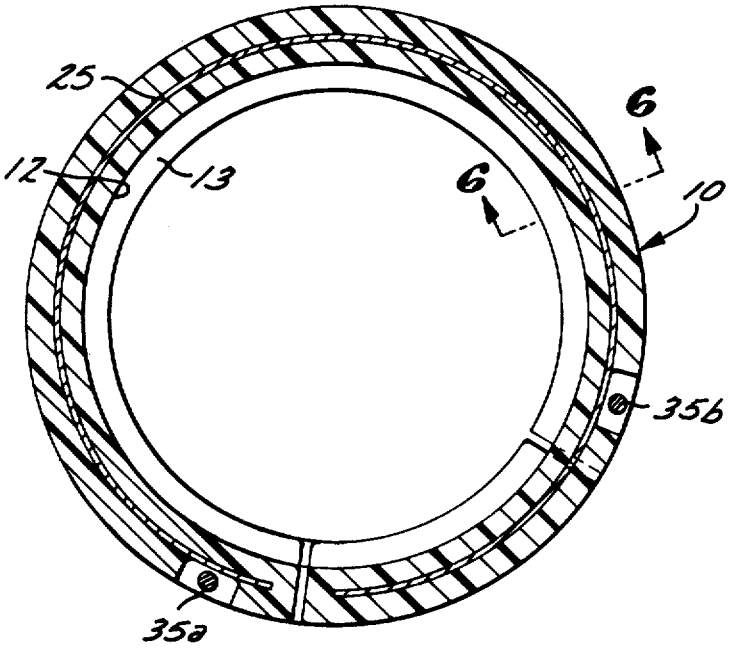
FIG. 2
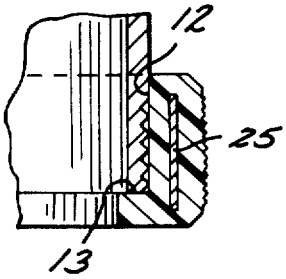
FIG. 6
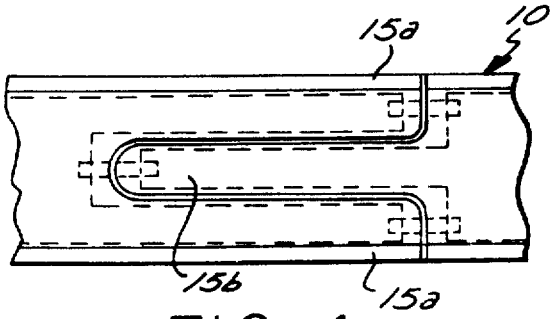
FIG. 4
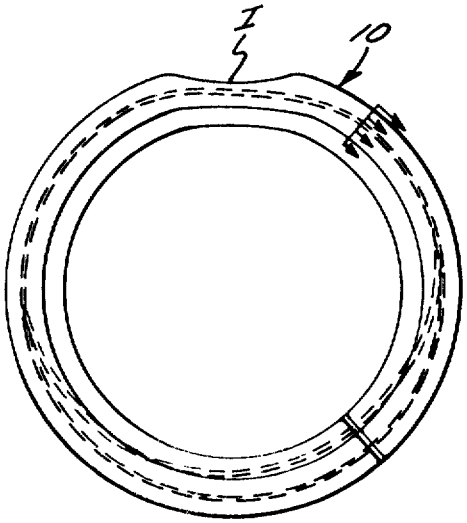
FIG. 5

PIPE THREAD PROTECTOR

BACKGROUND OF THE INVENTION

Field of the Invention

The present invention is a continuation-in-part of U.S. Pat. application Ser. No. 127,941 filed Mar. 7, 1980 (now abandoned) and relates to pipe thread protectors and more particularly to protectors conformed to engage the ends of drill pipe.

DESCRIPTION OF THE PRIOR ART

In the course of drilling wells, sections of drill pipe are frequently joined as new drilling depths are reached. Deep wells, like those recently drilled, often entail substantial numbers of pipe sections which, in the course of drilling, are handled extensively and are subject to damage. For this reason pipe end protectors have been developed in the past, an exemplary one being made by the Klampon Corp., 1481 Cota Avenue, Long Beach, California, and described in a sales brochure entitled, "Klampon Thread Protectors". Protectors of the foregoing kind typically include clamping devices which, in the course of protecting the pipe, sustain damage themselves. Thus, while suitable for their purpose, the above thread protectors increase drilling costs, an item already substantial in the cost of oil.

For the above reasons and reasons of simplicity end protectors of a more durable nature are sought. It is this search that is accommodated herein.

SUMMARY OF THE INVENTION

Accordingly, it is the general purpose of object of the present invention to provide a drill pipe protector substantially impervious to localized loads.

Other objects of the invention are to provide a drill pipe protector adapted to conform to pipes of various dimensions.

Yet further objects are to provide a method of forming drill pipe protectors which is convenient and inexpensive.

Additional objects of the invention are to provide a pipe thread protector of expandable configuration where the expansion is achieved through telescoping elements to accommodate various pipes.

Briefly, these and other objects are accomplished within the present invention by providing a circular spring shaped like a section of a tube and separated longitudinally along one side thereof to form a plurality of finger-like interlacing end projections. This spring is integrally cast within the body of a torroidal resilient cover provided with threaded interior surface to engage the threads at the end of a drill pipe. In order to facilitate installation and to accommodate pipes of various sizes the resilient cover is similarly separated along one longitudinal side in a separation once more conformed as a plurality of finger-like interlacing projections. This convolved separation in the side of the resilient protector body may be formed during molding or casting by way of a removable separator plate configured to extend through the mold.

It is contemplated to form the above cover from resilient material structure which is drawn against the exterior of the pipe by the hoop bias of the internally contained spring. This inward bias extends into the finger-like projections and thus expands the interlaced dimensions to lock the protector in place by friction. Any localized impacts on the exterior of the protector effectively extend the exterior hoop dimension of the cover adding to the interior hoop bias to hold the cover in place.

In an alternative form the convolved separation may be formed along angles offset from the radial plane thus providing a pocket for each finger-like projection for telescopic expansion. This last arrangement allows for various expansions without exposing a gap.

BRIEF DESCRIPTION OF THE DRAWINGS

FIG. 1 is a perspective illustration of the inventive protector mounted on the end of a drill pipe;

FIG. 2 is a top sectional view taken along line 2—2 of FIG. 1;

FIG. 3 is a perspective illustration of a detail useful in the forming of the inventive protector set out herein;

FIG. 4 is a front plan view detail of a separator set out in FIG. 3;

FIG. 5 is yet another plan view of the inventive protector illustrating the distortion thereof on impact;

FIG. 6 is a sectional view taken along line 6—6 of FIG. 2;

DESCRIPTION OF THE PREFERRED EMBODIMENTS

Figure 7:
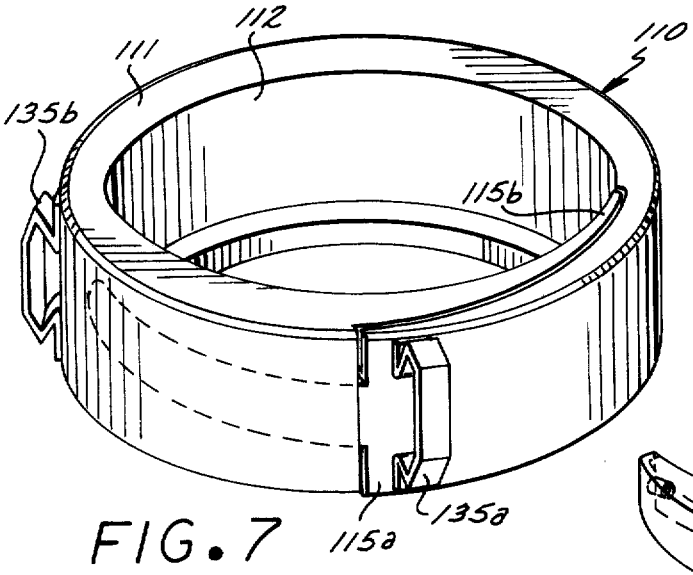
FIG. 7 is yet another embodiment of a pipe thread protector conformed to include telescoping elements for expansion.

As shown in FIGS. 1 and 2 an inventive drill pipe protector, generally designated by the numeral 10, comprises an annular resilient cover 11 defining a threaded interior surface 12 conformed to engage the threads at the end of a drill pipe P. In this form the cover 11 is generally shaped like a section of a tube terminating in an interiorly directed lip 13 at the upper edge. This tubular section is split along one side for expansion by way of a convolved separation defined by a plurality of interlacing fingers 15*a* and 15*b* which extend to enclose the pipe.

Buried within the interior of the cover 11 is a tubular spring 25 again separated to form a plurality of interlacing fingers 25*a* and 26*b*. As will be described hereinafter spring 25 is disposed within the cover 11 and thus the separations between the adjoining edges thereof are dimensioned to accommodate the cover thickness. This may be achieved in the course of molding or casting, it being intended to spread the separation in the spring for this process. Thus an inward spring bias is achieved forcing the interior surface 12 against the threaded exterior of the pipe.

To accommodate installation and removal cover 11 may be provided with integrally cast hand holds 35*a* and 35*b* adjacent the projections 15*a* and 15*b*. Thus the cover 11 and the spring 25 therein, may be spread on installation and removal. Once installed the inward hoop bias of spring 25 will expand by compression, the lateral dimension of the interlaced projections to accomplish a frictional engagement therebetween.

The foregoing assembly may be conveniently formed by injection molding. In the course of this process material like neoprene may be used to form the cover 11, spring 25 being first placed in the mold. To provide the desired interlacing separation a convolved separator 50, shown in FIGS. 3 and 4, may be placed between the adjacent edges of the spring 25 expanding the spring outwardly by a plurality of spacers 50*a* and 50*b*. Once the material sets this separator may then be removed and reused. In this manner an inward bias in spring 25 is insured which also assists in the installation of the spring prior to molding. Furthermore, each of the projections 15*a* and 15*b* is thus separated by the thickness of the separator 50, insuring a closely conforming geometry which is deformed for interference fit on installation.

As shown in FIG. 5 any impact I to the exterior of cover 11 will result in an expansive deformation locally adding to the inward bias. Thus the protector will be retained in position and only outward forcing of the hand holds will facilitate removal.

Figure 8:
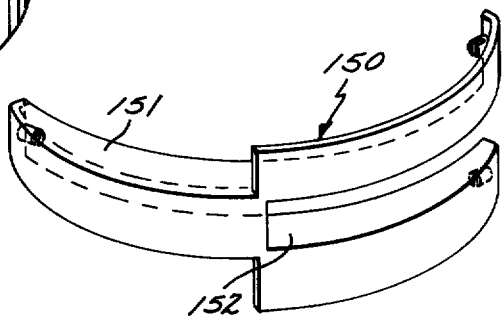
FIG. 8 is a perspective illustration of a separator useful in forming the pipe thread protector shown in FIG. 7.
Figure 9:
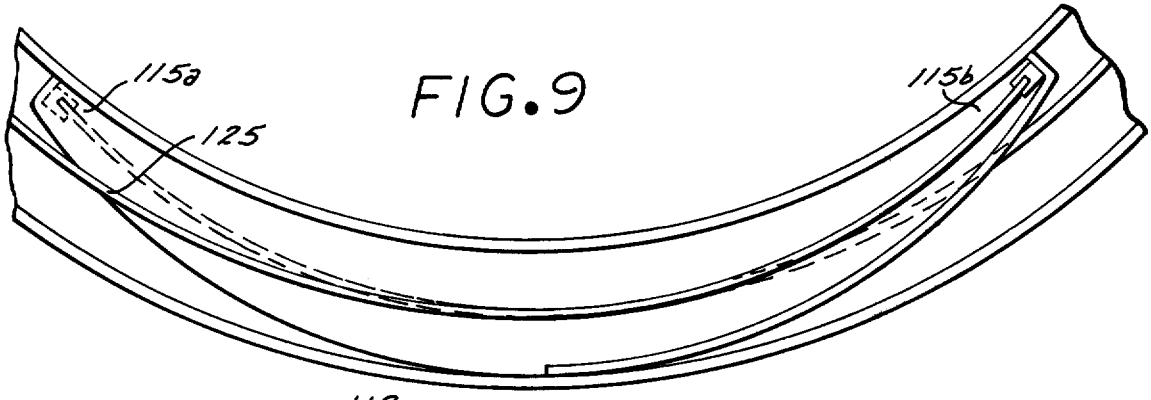
FIG. 9 is a top view detail illustrating the arrangement of the separator shown in FIG. 8 during forming.
Figure 10:
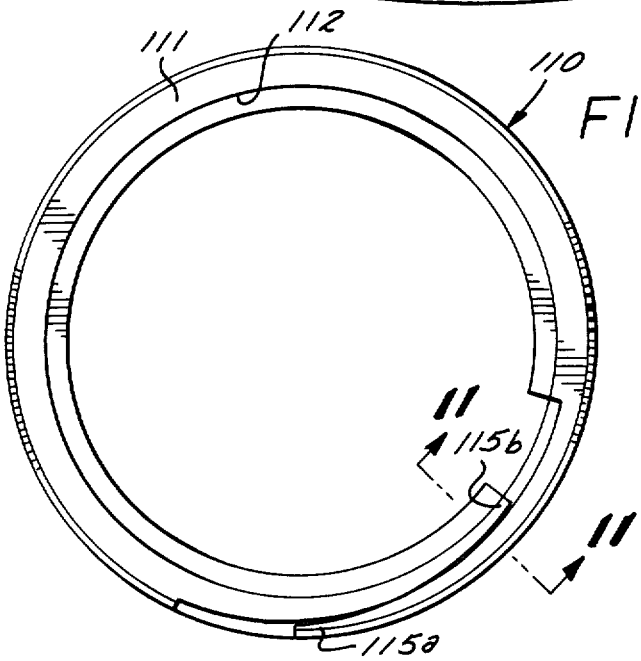
FIG. 10 is a top view of the pipe thread protector shown in FIG. 7 illustrating the expansion thereof.
Figure 11:
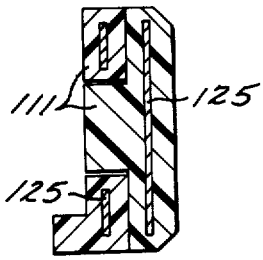
FIG. 11 is a sectional detail taken along line 11—11 of FIG. 10.

The alternative implementation of the foregoing features may be achieved according to FIGS. 7–11. In these illustrations a protector 110 is once more formed to include a resilient cover 111 provided with a threaded interior surface 112. This annular configuration may be split along one side to form a plurality of interlacing finger-like projections 115*a* and 115*b*. These projections are formed during molding by a separator 150 convolved as a part of a circle of a diameter smaller than the diameter of protector 110. The segment of the circle subtended by separator 150 is selected to completely separate the annulus. The separator 150 includes radial surfaces 151 and 152 which extend to the inside surface 112, thus forming both the projections 115*a* and 115*b* and pockets therefor. Hand holds 135*a* and 135*b* may also be provided for separation.

In this last form each of the projections 115*a* and 115*b* telescopes out of its pocket. Thus full enclosure of the thread is achieved at various spreads. The protector is thus capable of full thread protection which on impact assures further engagement between the separated surfaces. Once again, the internal leaf spring 125 is spread during casting for inward bias and on installation the outward deformation insures a good interlace.

Obviously many modifications and changes may be made to the foregoing description without departing from the spirit of the invention. It is therefore intended that the scope of the invention be determined solely on the claims appended hereto.

What is claimed is:

1. A pipe thread protector for use on the ends of a drill pipe, comprising:

a tubular spring split along one side by a convolved separation to form a plurality of interlacing fingers, said spring being prestressed to urge said fingers into an overlapping alignment;

a resilient covering formed to surround said tubular spring and including a plurality of conformingly interlacing projections on the exterior of said fingers to urge the separation thereof, said covering defining an interior opening provided with a thread engaging surface; and a first and second handle formed in said covering adjacent said separation for manipulation thereof.

2. Apparatus according to claim 1 wherein:

said interior opening includes an inwardly directed lip proximate one edge thereof for engaging said pipe.

3. Apparatus according to claim 2 wherein:

said spring is aligned for inward bias.

4. Apparatus according to claim 1 wherein:

said covering includes interior recesses for receiving said projections therein.

5. A method of forming a pipe thread protector comprising the steps of:

fabricating a tubular spring having a separation along one side in the form of a plurality of interlaced fingers;

spreading said separation by installing a separating plate therebetween;

installing said spring and said separating plate on the interior of a toroidal mold conformingly mated to said separating plate; and injecting resilient matter into said mold.

6. A method according to claim 1 wherein the step of spreading further includes the step of providing spreaders on said separating plate for spreading said fingers therefrom.

* * * * *